United States Patent [19]

Trubody

[11] 4,119,310

[45] Oct. 10, 1978

[54] PLAYGROUND TURNTABLE

[75] Inventor: Bert M. Trubody, Oakland, Calif.

[73] Assignee: Patterson-Williams Manufacturing Company, Santa Clara, Calif.

[21] Appl. No.: 790,522

[22] Filed: Apr. 25, 1977

Related U.S. Application Data

[62] Division of Ser. No. 671,181, Mar. 26, 1976, abandoned.

[51] Int. Cl.[2] ..... A63G 1/12

[52] U.S. Cl. ..... 272/33 R; 188/82.84; 188/82.9; 192/46

[58] Field of Search ..... 272/33 R, 72; 192/46; 188/82.8, 82.84, 82.9

[56] References Cited

U.S. PATENT DOCUMENTS

| | | | |
|---|---|---|---|
| 615,614 | 12/1898 | Flood | 192/46 |
| 943,276 | 12/1909 | Setecka et al. | 272/33 R |
| 1,142,970 | 6/1915 | Koehler | 272/33 R |
| 1,330,407 | 2/1920 | Svenson | 192/46 |
| 1,629,585 | 5/1927 | Oulton | 192/46 |
| 1,878,758 | 9/1932 | Clayton | 272/33 R |
| 2,060,376 | 11/1936 | Jex | 188/82.84 X |
| 3,170,687 | 2/1965 | Lugger | 272/33 R |
| 3,612,518 | 10/1971 | Bennett | 272/33 R |

FOREIGN PATENT DOCUMENTS

| | | | |
|---|---|---|---|
| 28,937 | 10/1884 | Fed. Rep. of Germany | 272/33 R |
| 1,206,450 | 8/1959 | France | 188/82.9 |
| 8,503 of | 1908 | United Kingdom | 272/33 R |

OTHER PUBLICATIONS

J. E. Burke Company Catalog, New Brunswick, N. J., Received Feb. 19, 1975, p. 31, Merry-Go-Round.

Miracle Equipment Company Catalog Sampler #500, Grinnell, Iowa, 50112, Received Feb. 24, 1966, p. 8, Miracle Mustang Whirl.

*Primary Examiner*—Richard C. Pinkham
*Assistant Examiner*—Arnold W. Kramer
*Attorney, Agent, or Firm*—Townsend and Townsend

[57] ABSTRACT

A merry-go-round or playground turntable comprises a rotatable platform, a fixed shaft segment coaxially supporting the platform, a rotatable shaft segment, a ratchet drive coaxially coupling the rotatable shaft segment to the fixed shaft segment, and a hand wheel mounted to the rotatable shaft segment. The turntable is operable to rotate in only one direction is response to torque applied to the hand wheel by at least one operator, typically a young or handicapped child, supported on the platform. The ratchet drive permits the operator to turn the platform while continuously grasping the hand wheel.

2 Claims, 7 Drawing Figures

PLAYGROUND TURNTABLE

This is a division, of application Ser. No. 671,181 filed Mar. 26, 1976, and now abandoned.

BACKGROUND OF THE INVENTION

I. FIELD OF INVENTION

This invention relates to turntable playground equipment and particularly to a turntable operative to rotate in response to force applied to a portion of the apparatus by a person supported thereon.

II. DESCRIPTION OF THE PRIOR ART

Playground turntables or merry-go-rounds are among the most popular and entertaining of playground equipment. A variety of playground turntables are known in which the operator, typically a child, turns a rotatable support platform by applying a hand force to a stationary hand wheel attached to a fixed coaxial standard. U.S. Pat. Nos. 2,785,896 and 3,873,087 are but two examples of such turntables. Such turntables are somewhat unsuited to use by the very young or handicapped child. To operate, the child must be able to advance hand over hand around the hand wheel. Most young children and many handicapped children lack the sufficient manual control and coordination to release and regrasp a stationary hand wheel to rotate a turntable. As a result, the very young or handicapped child is seldom able to enjoy such playground equipment. Moreover, the typical turntable of the prior art may be a safety hazard since a child lacking sufficient control and coordination to release and regrasp the hand wheel as required may lose his or her grip and fall from the turntable.

The prior art discloses roundabouts and rotary lawn swings having means of hand propulsion other than a fixed hand wheel. For example, U.S. Pat. No. 1,368,132 discloses a roundabout equipped with a fixed hand wheel and in addition a lever coupled to a fixed coaxial standard by means of a ratchet device. According to the disclosure, the ratchet lever may be employed as an alternative propulsion means. U.S. Pat. No. 1,143,454 discloses a rotary lawn swing equipped with a circular hand rail which may be locked to a coaxial standard by means of a circular clutch mechanism adjacent the hand rail. According to the disclosure, a seated operator may propel the swing by pulling upon the hand rail. The hand rail is free to turn in the direction of rotation when the adjacent clutch is engaged. Thus the operator need not release the hand rail to continue rotation.

In the case of both the U.S. Pat. Nos. 1,368,132 and 1,143,454, the inventions disclosed therein are generally unsuited for operation by very young or handicapped children, and are better suited to adult amusement. For example, seats are provided which may be unacceptable to a young child, since the presence of seats permits and may even encourage the user to release his or her grasp of the hand wheel, which is undesirable from a safety standpoint. Furthermore, the engagement and advancement mechanisms such as the clutch required in the U.S. Pat. No. 1,143,454 patent or the lever included in the U.S. Pat. No. 1,368,132 patent add unnecessary and undesirable complexity to a turntable intended for use by a very young or handicapped child.

It is therefore desirable to provide a playground turntable which is simple, reasonably safe, and especially suitable for use by very young or handicapped children.

SUMMARY OF THE INVENTION

The invention is embodied in a merry-go-round or playground turntable comprising a rotatable platform, a fixed shaft segment coaxially supporting the platform, a rotatable shaft segment, a ratchet drive coaxially coupling the rotatable shaft segment to the fixed shaft segment, and a hand wheel mounted to the rotatable shaft segment. The turntable is operable to rotate in only one direction in response to torque applied to the hand wheel by at least one operator, typically a young child supported on the platform. The ratchet drive permits the operator to turn the platform while continuously grasping the hand wheel. The hand wheel coupled to the ratchet drive is the sole control and propulsion means. The hand wheel is also typically the only gripping means so that the operator is obliged to maintain a grasp of the hand wheel during operation.

It is a primary object of this invention to provide a playground turntable which may be rotatably propelled by a coaxial hand wheel wherein the user need not release the grasp thereof. This is accomplished by providing a ratchet gear coupling a rotatable hand wheel to a fixed support standard. The turntable is rendered thereby relatively safe for the very young or handicapped child since he or she is less likely to tumble from the turntable as a result of lost grip.

A further object of the invention is to provide a hand wheel-driven rotatable turntable having a minimum of functional parts and controls. This is accomplished by providing a self-contained ratchet gear that couples the rotatable wheel to the fixed standard. Clutches, reversing gears, protrusions and levers which might confuse or even injure the young or handicapped child user are specifically avoided.

BRIEF DESCRIPTIONS OF THE DRAWINGS

The invention may more readily be understood by reference to the following detailed description of specific embodiments in conjunction with the accompanying figures in which.

Figure 4A:
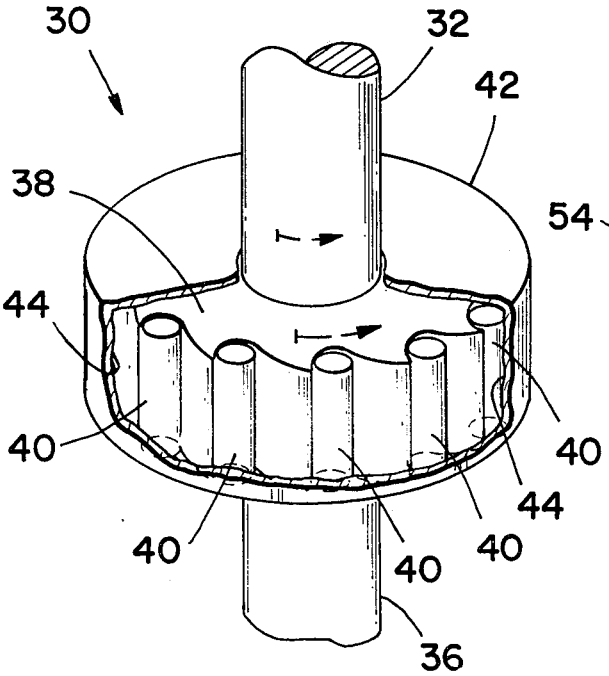
Figure 4B:
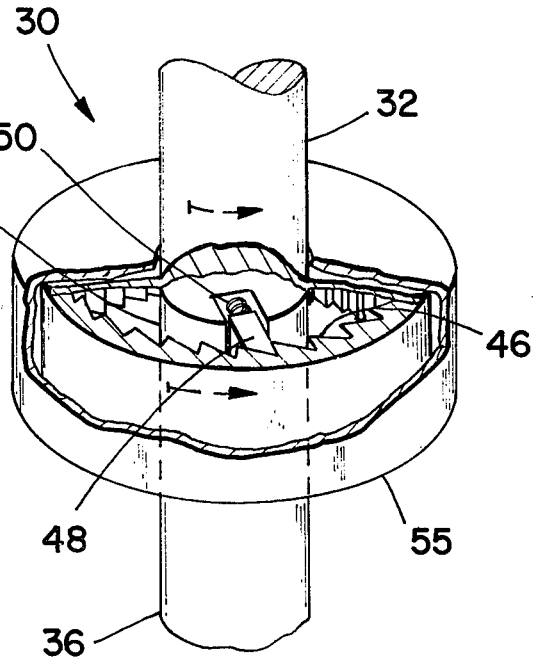
Figure 4C:
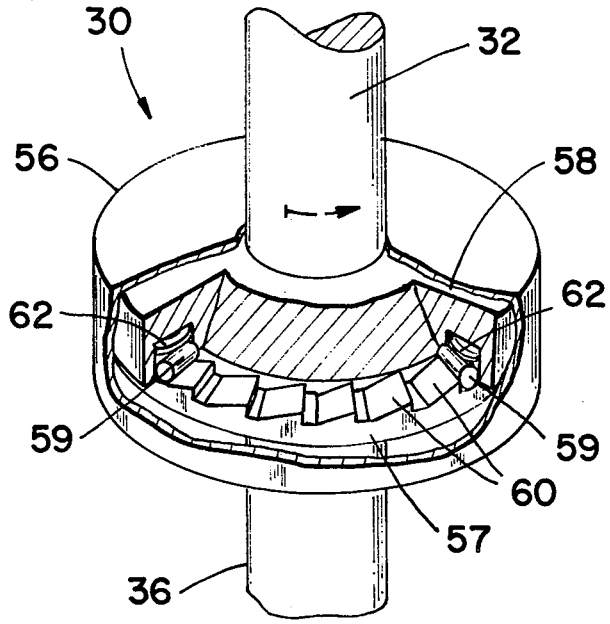
Figure 5:
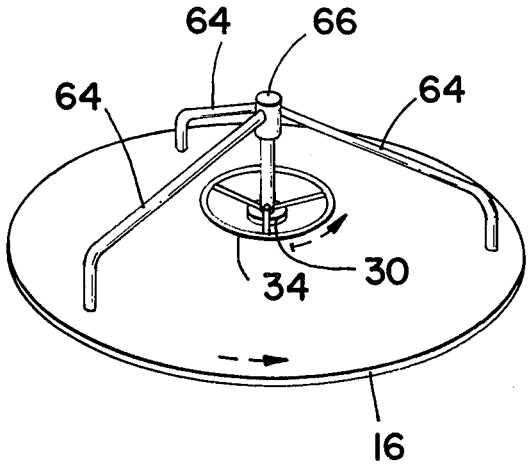

FIG. 4*a*, 4*b* and 4*c* show preferred embodiments of ratchet mechanisms; and FIG. 5 is a side perspective view as a further embodiment of the invention.

DETAILED DESCRIPTION OF THE SPECIFIC EMBODIMENTS

Figure 1:
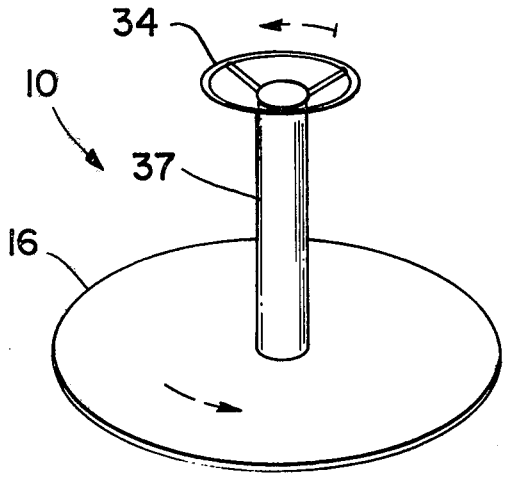
FIG. 1 is a side perspective view of a turntable according to the present invention.
Figure 2:
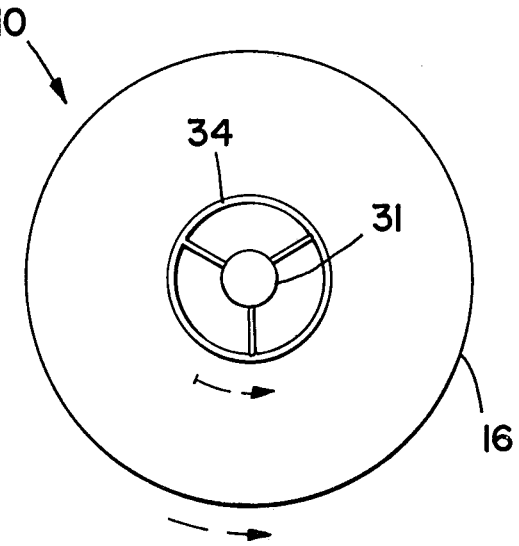
FIG. 2 is a top plan view thereof.
Figure 3:
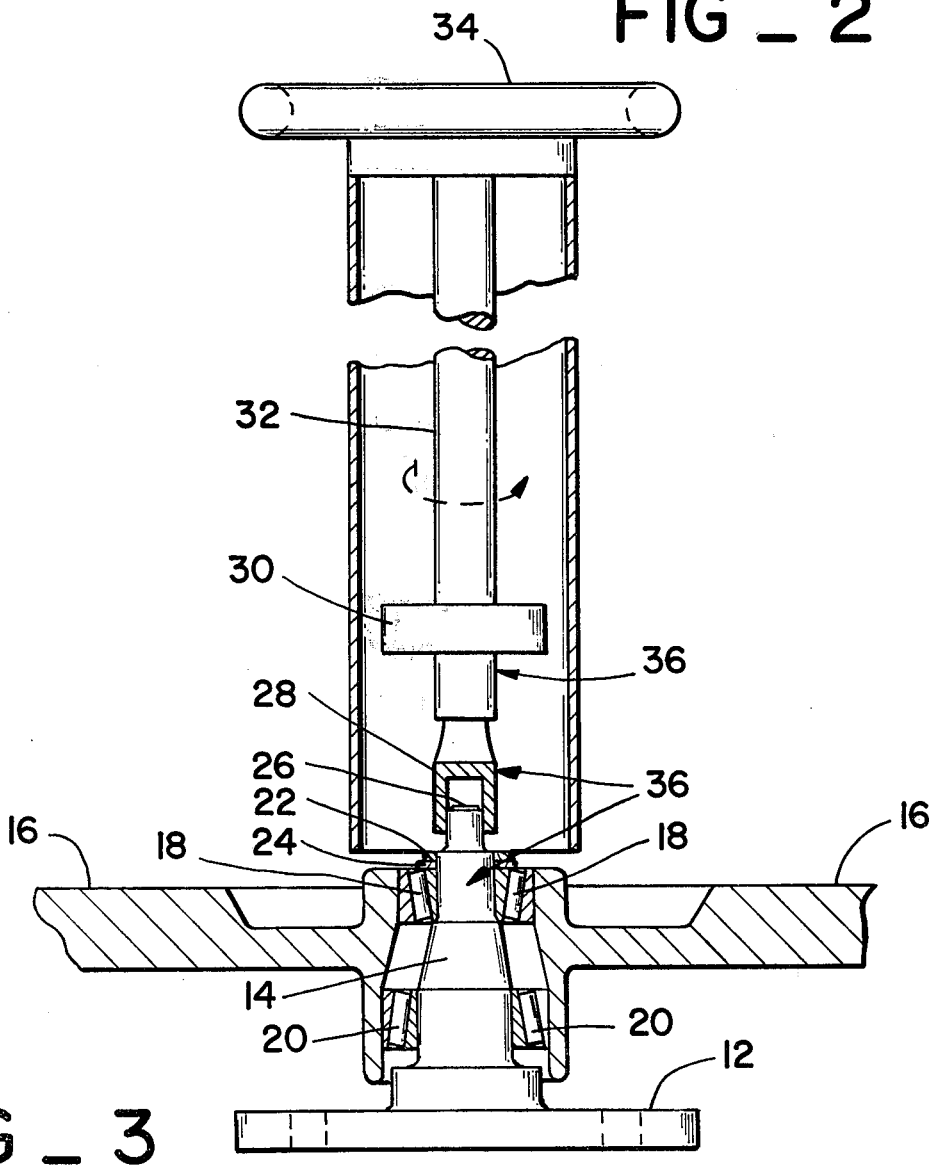
FIG. 3 is a vertical sectional view partially in elevation and partially cut away, of the turntable of FIG. 1.

With particular reference to FIGS. 1, 2 and 3, a playground turntable, referred to generally as 10, is depicted. The turntable includes a base 12 which may be integral with a spindle 14, a rotatable platform 16 coupled to the spindle 14 by an upper bearing 18 and a lower bearing 20. The platform 16 is coupled or locked to the spindle 14 by means of a locking nut 22 and lock washer 24. The spindle 14 includes an end portion 26 which may extend above the level of the platform 16. The end portion 26 is mated to an adapter coupling 28. The end portion 26 may be squared, or it may be keyed or pinned to the adapter coupling 28.

The adapter coupling 28 may be welded or otherwise fixedly coupled to a ratchet mechanism 30 which in turn is coupled to a connecting shaft 32 supporting a control wheel 34 at a selected height above the platform 16. In the embodiment of FIGS. 1, 2 and 3, the control wheel 34 is provided at a height suitable or convenient to a relatively small person such as a young child in a standing position on the platform 16.

The axis from the base 12 to the ratchet mechanism 30 defines a fixed shaft segment 36 with respect to the rotatable platform 16. A protective hollow cylindrical column 37 enshrouds the fixed shaft segment 36, the ratchet mechanism 30 and the connecting shaft 32. The column 37 may be attached to the control wheel 34. The ratchet mechanism 30 couples the connecting shaft segment 32 to the fixed shaft segment 36 permitting only an unidirectional revolving motion of the connecting shaft 32, as indicated by arrows of motion.

The ratchet mechanism 30 may be either a tooth ratchet or a roller ratchet. FIGS. 4*a*, 4*b* and 4*c* depict three suitable ratchet gears useful in the ratchet mechanism 30. FIG. 4*a* depicts a roller ratchet which includes a driver 38 and a plurality of rollers 40 enclosed in a casing 42. The inner wall of the casing confronting the rollers 40 defines a follower 44. The fixed shaft segment 36 may be attached to the casing 42 while the connecting shaft 32 may be attached to the driver 38. In the roller ratchet, rollers 44 permit the driver 38 to rotate freely in one direction. If driver rotation is attempted in the opposite direction, the rollers 40 become wedged between the driver 38 and the follower 44. One advantage of the roller-type ratchet is its relatively noiseless shock-free operation.

FIG. 4*b* depicts a further embodiment of the ratchet mechanism 30, which includes a toothed ratchet drum 46 confronting a pawl 48 biased by a spring 50 against asymmetric teeth 52 protruding inwardly from the interior face of the toothed drum 46. A central shaft 54 supporting the pawl 48 is fixedly attached to the fixed shaft segment 36. The connecting shaft 32 is attached to the ratchet drum 46 in any suitable manner. The workings of the ratchet mechanism may be protected by a casing 55, which may also serve as a bearing for the ratchet mechanism 30.

FIG. 4*c* depicts a still further embodiment of the ratchet mechanism 30 wherein the fixed shaft segment 36 is coupled to the casing 56 enclosing a ratchet disc 57 fixedly attached to the fixed segment 36. Also enclosed within the casing 56 confronting the ratchet disc 57 is a rotatable disc 58 fixedly attached to the connecting shaft 32. Enclosed within the rotatable disc 58 on the side confronting the ratchet disc 57 is at least one ball-bearing catch roller 59 adapted to engage teeth 60 of the toothed disc 57. Catch rollers 59 may engage the recesses of the teeth 60 under the force of gravity or may be biased by springs 62 disposed within the rotatable disc 58.

In the embodiments of both FIGS. 4*b* and 4*c*, relatively free motion of the connecting shaft 32 is permitted in one direction, as indicated by motion arrows, whereas the teeth of the ratchet and the pawl or roller arrest rotation in the opposite direction. Many other embodiments of the ratchet mechanism may also be suitable so long as relatively free motion is permitted in one direction and arrested in the opposite direction. It should be understood that the mechanism must be sufficiently rugged to withstand the applied torque.

FIG. 5 depicts a still further embodiment of the invention having further inventive features. This embodiment includes a platform 16 of a diameter sufficient for a child to be seated or to kneel thereon and a plurality of radially disposed railings 64 joined at a central axis 66 directly above a hand wheel 34. A central shaft 68 may optionally be included which extends to the hub of the hand wheel 34. The hand wheel 34 may be disposed adjacent the floor of the platform 16, permitting a user to comfortably grip the wheel while in a seated or kneeling position. The ratchet mechanism 30, necessary for operation, may be disposed immediately below the hand wheel 34 coupling it to a connector segment fixed to the base below the platform 16.

Although the manner in which the turntable would be used is believed apparent, a brief explanation will be given. A user, typically a small or handicapped child may stand, kneel or be seated on the platform assembly 16. The user may grasp the hand wheel 34 and by hand torque pulling upon the wheel cause the platform 16 assembly and himself to revolve in the direction opposite to the direction of pull. At no time need the user release his grip upon the control wheel 34 since the ratchet mechanism 30 permits the control wheel 32 to rotate freely in the direction of platform revolution.

While the above provides a full and complete disclosure of the preferred embodiments of the present invention, other embodiments will be apparent to those of ordinary skill in the art upon reference to this disclosure. It is therefore not intended that the invention be limited except as defined in the appended claims.

What is claimed is:

1. A playground turntable comprising a horizontal occupant supporting platform rotatable about a fixed vertical axis; a fixed shaft segment coaxially supporting said rotatable platform; a rotatable shaft segment; a ratchet drive coaxially coupling said rotatable shaft segment to said fixed shaft segment for permitting only unidirectional rotation of said rotatable shaft segment; a handcontrolled wheel mounted to said rotatable shaft segment in a position permitting a user on said platform to continuously grip said control wheel while propelling said platform in unidirectional rotation, upon intermittent application of a hand torque to said control wheel, said ratchet drive comprising first and second flat plates extending perpendicular to and coaxial with said vertical axis, said first plate fixedly secured to said first shaft and having a plurality of upstanding teeth extending radially outward and arranged in a circle around said fixed shaft, said second flat plate having a face with a plurality of elongated radially extending recesses arranged about said vertical axis and confronting said teeth, elongated roller bearings corresponding in number to and disposed in each of said recesses, and means urging said roller bearings against said teeth.

2. A turntable in accordance with claim 1 wherein said roller urging means are respective springs in said recesses for urging said rollers into engagement with the teeth of said first plate.

* * * * *